US007503197B2

(12) United States Patent
Ghiran et al.

(10) Patent No.: US 7,503,197 B2
(45) Date of Patent: Mar. 17, 2009

(54) APPARATUS FOR HOLE PUNCHING

(75) Inventors: Mike M. Ghiran, Lake Orion, MI (US); Kevin R. Marks, Durand, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 108 days.

(21) Appl. No.: 11/674,737

(22) Filed: Feb. 14, 2007

(65) Prior Publication Data

US 2008/0190163 A1 Aug. 14, 2008

(51) Int. Cl.
*B21D 28/28* (2006.01)
*B21D 26/02* (2006.01)

(52) U.S. Cl. ..... 72/55; 72/56; 29/421.1

(58) Field of Classification Search ..... 72/54, 72/55, 56, 58; 29/421.1
See application file for complete search history.

(56) References Cited

U.S. PATENT DOCUMENTS

| | | | | |
|---|---|---|---|---|
| 5,398,533 | A | 3/1995 | Shimanovski | |
| 5,666,840 | A * | 9/1997 | Shah et al. | 72/55 |
| 5,799,524 | A * | 9/1998 | Schafer et al. | 72/55 |
| 5,941,112 | A | 8/1999 | Ghiran et al. | |
| 6,067,830 | A | 5/2000 | Klages et al. | |
| 6,098,437 | A * | 8/2000 | Kocer et al. | 72/55 |
| 6,401,507 | B1 | 6/2002 | Krcek et al. | |
| 6,434,989 | B1 * | 8/2002 | Hardtke | 72/55 |
| 6,442,820 | B1 * | 9/2002 | Mason | 29/421.1 |
| 6,658,908 | B1 | 12/2003 | Ghiran et al. | |
| 6,672,120 | B1 | 1/2004 | Ghiran | |

FOREIGN PATENT DOCUMENTS

| | | |
|---|---|---|
| DE | 10029319 C1 | 5/2001 |
| DE | 60002726 T2 | 10/2003 |

* cited by examiner

*Primary Examiner*—David B Jones

(57) ABSTRACT

Apparatus is provided for punching holes through the opposed first and second tube walls of a hydroformed tube while the tube is within the die cavity formed by a pair of hydroforming dies. A punch is mounted within a punch bore that intersects with the die cavity. A punch advances the punch to punch a first hole in the first tube wall and then travel across the die cavity and make a second hole in the second tube wall. A support mechanism for supporting the second wall of the tube against rupture by the hydroforming pressure includes spring biasing a support face of a support rod into engagement with the second wall and yielding during the punching of the second hole. A support rod actuator withdraws the support rod to carry the support face away from the second wall after the second hole is punched.

11 Claims, 5 Drawing Sheets

APPARATUS FOR HOLE PUNCHING

FIELD OF THE INVENTION

The present invention relates to the punching of holes through the opposed walls of a tube while the tube is in a hydroforming die cavity.

BACKGROUND OF THE INVENTION

It is known in the manufacture of motor vehicles to form tubular structures such as roof rails and frame rails and other parts by capturing a tube with a die cavity, sealing the ends of the tube, and introducing pressurized fluid to expand the tube into a shape defined by the die cavity. In the interest of economies of manufacture, it is desirable to perform additional operations on the hydroformed part such as the punching of holes while the part is still captured within the die and subject to internal pressure by the pressurized fluid.

It would be desirable to provide a new and improved apparatus for using a single punch to punch a first hole in one wall of the tube and having that same punch travel across the inside of the tube and punch a second hole in the other wall of the tube.

SUMMARY OF THE INVENTION

Apparatus is provided for punching holes through the opposed first and second tube walls of a hydroformed tube while the tube is within the die cavity formed by a pair of hydroforming dies. A punch is mounted within a punch bore that intersects with the die cavity. A punch actuator advances the punch to punch a first hole in the first tube wall and then travel across the die cavity and punch a second hole in the second tube wall. A support mechanism for supporting the second wall of the tube against rupture by the hydroforming pressure includes a spring that biases a support face of a support rod into engagement with the second wall and yields during the punching of the second hole. A support rod actuator withdraws the support rod to carry the support face away from the second wall after the second hole is punched.

The detailed description and specific examples herein, while indicating exemplary embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE EXEMPLARY EMBODIMENTS

The following description of certain exemplary embodiments is merely exemplary in nature and is not intended to limit the invention, its application, or uses.

Figure 1:
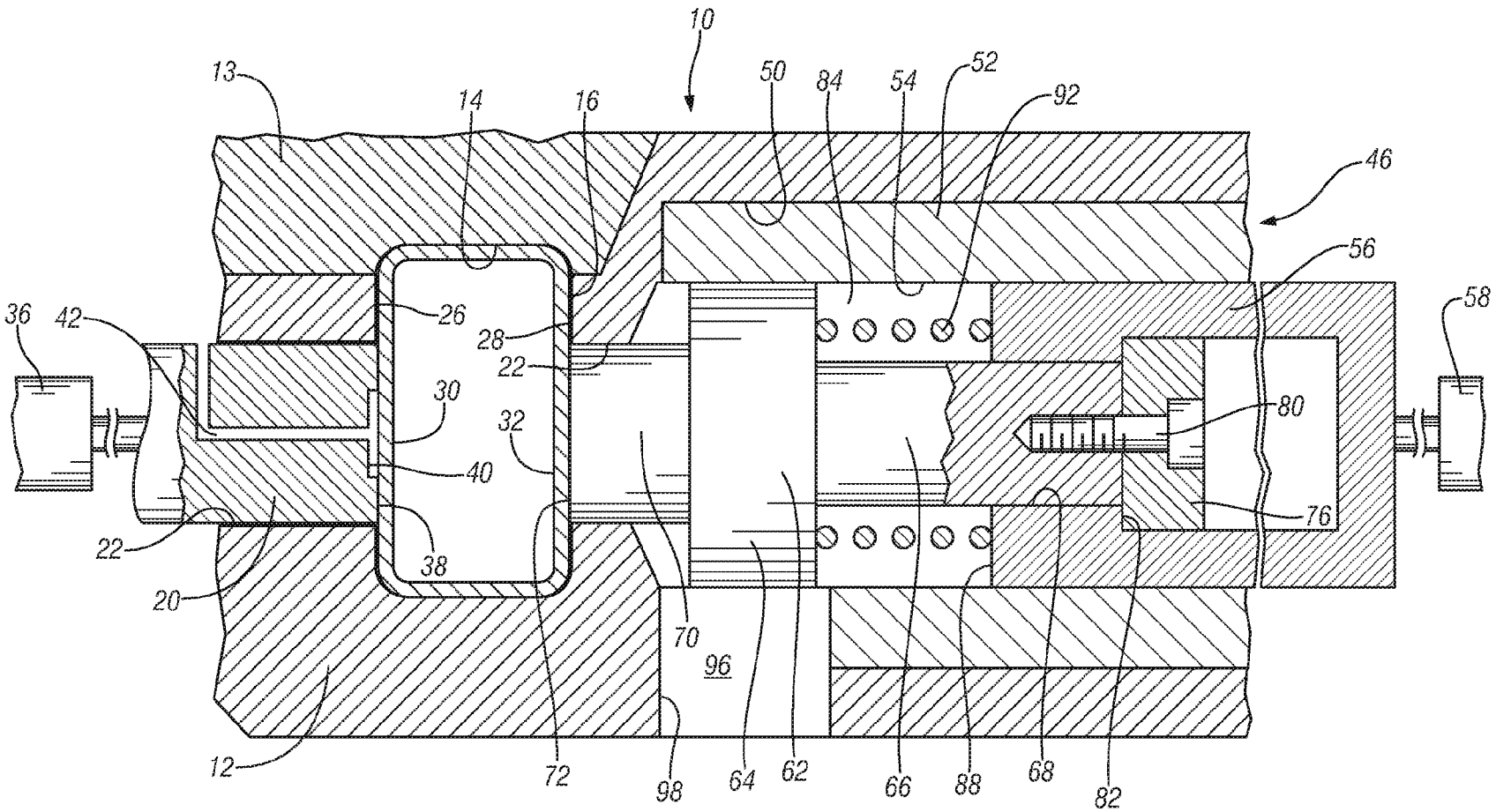
FIG. 1 is a section view taken through a tube captured in a hydroforming die having a punch apparatus according to the invention.

Referring to FIG. 1, a hydroforming die, generally indicated at 10, includes a lower die 12 and an upper die 13 that cooperate to define a cavity 14 in which a tube 16 is positioned. As is customary in hydroforming processes, the ends of the tube 16 are sealed and then the tube 16 will be filled with fluid. The fluid will be pressurized and the walls of the tube 16 forced outwardly to the shape defined by the shape of the die cavity 14.

Also as seen in FIG. 1, a punch 20 is slidable within a punch bore 22 that is provided in the lower die 12. The punch bore intersects the cavity 14 at the left wall 26 of the cavity 14 and also continues on the other side of the cavity 14 and into the right cavity wall 28 of the cavity 14 so that the punch 20 will be able to travel all the way across the cavity 14 and thereby punch a hole in both the left tube wall 30 of tube 16 and the right tube wall 32 of the tube 16. The punch 20 is attached to a hydraulic cylinder 36 or other actuator. The hydraulic cylinder 36 will normally support the punch 20 at the position shown in FIG. 1 in which the punch face 38 is flush with the left wall 26 of cavity 14 in order to support the left tube wall 30 against the fluid pressure. The punch face 38 has a counter bore 40 that communicates with a vent hole 42 provided in the punch 20, as will be discussed hereinafter.

A support mechanism, generally indicated at 46, is provided within lower die 12 adjacent to the right cavity wall 28 of the cavity 14. The lower die 12 has a large bore 50 that communicates with the punch bore 22 and houses the support mechanism 46. A bushing 52 is seated within the large bore 50 of the lower die 12. The bushing 52 has a bushing bore 54 and a shaft 56 is slidable with the bushing bore 54. The shaft 56 is attached to a hydraulic cylinder 58, or other actuator.

A support rod 62 is mounted on the shaft 56, and includes a bearing portion 64 that slides in the bushing bore 54, a stem 66 that slides within a shaft bore 68 of the shaft 56, and a support portion 70 that slides within the punch bore 22. The support portion 70 of the support rod 62 has a support face 72 that fits closely within the punch bore 22. The sliding of the stem 66 within the shaft bore 68 is limited by a stop washer 76 that is mounted on the end of the stem 66 by a bolt 80. The stop washer 76 will engage with a shoulder 82 of the shaft bore 68 so that shaft 56 can withdraw the support rod 62 to the right as will be discussed hereinafter.

As seen in FIG. 1, a chamber 84 is defined by the space between the bearing portion 64 of the support rod 62 and the end face 88 of the drive shaft 56. A coil compression spring 92 is located within the chamber 84 and seats against the bearing portion 64 and the shaft end face 88 to establish the support rod 62 at an extended position relative to the shaft 56 as determined by the engagement of the stop washer 76 with the shoulder 82 of the shaft bore 68.

Figure 4:
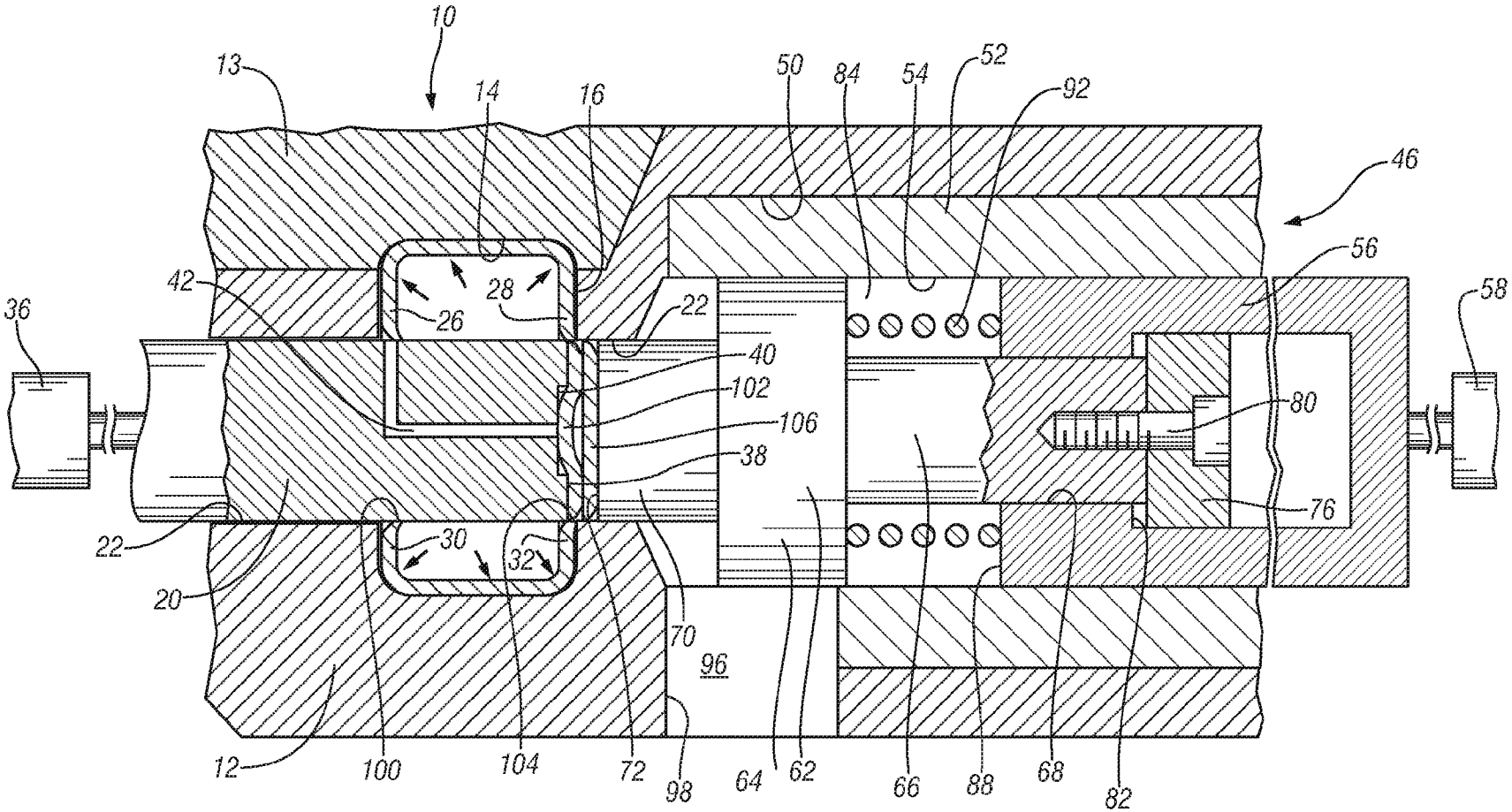
FIG. 4 is a view similar to FIG. 1 but showing that the punch has been advanced further to punch a hole in the second wall of the tube.

As best seen in FIG. 4, the lower die 12 has a discard chute 96 that is formed by a bore 98 that intersects with the punch bore 22 and the bushing bore 54.

Operation

Referring to FIG. 1, tube 16 is captured within the die cavity 14. The punch face 38 of the punch 20 is positioned flush with the left cavity wall by effort of the hydraulic cylinder 36. The support face 72 of the support rod 62 is positioned flush with the right cavity wall 28 by the effort of the coil compression spring 92.

Figure 2:
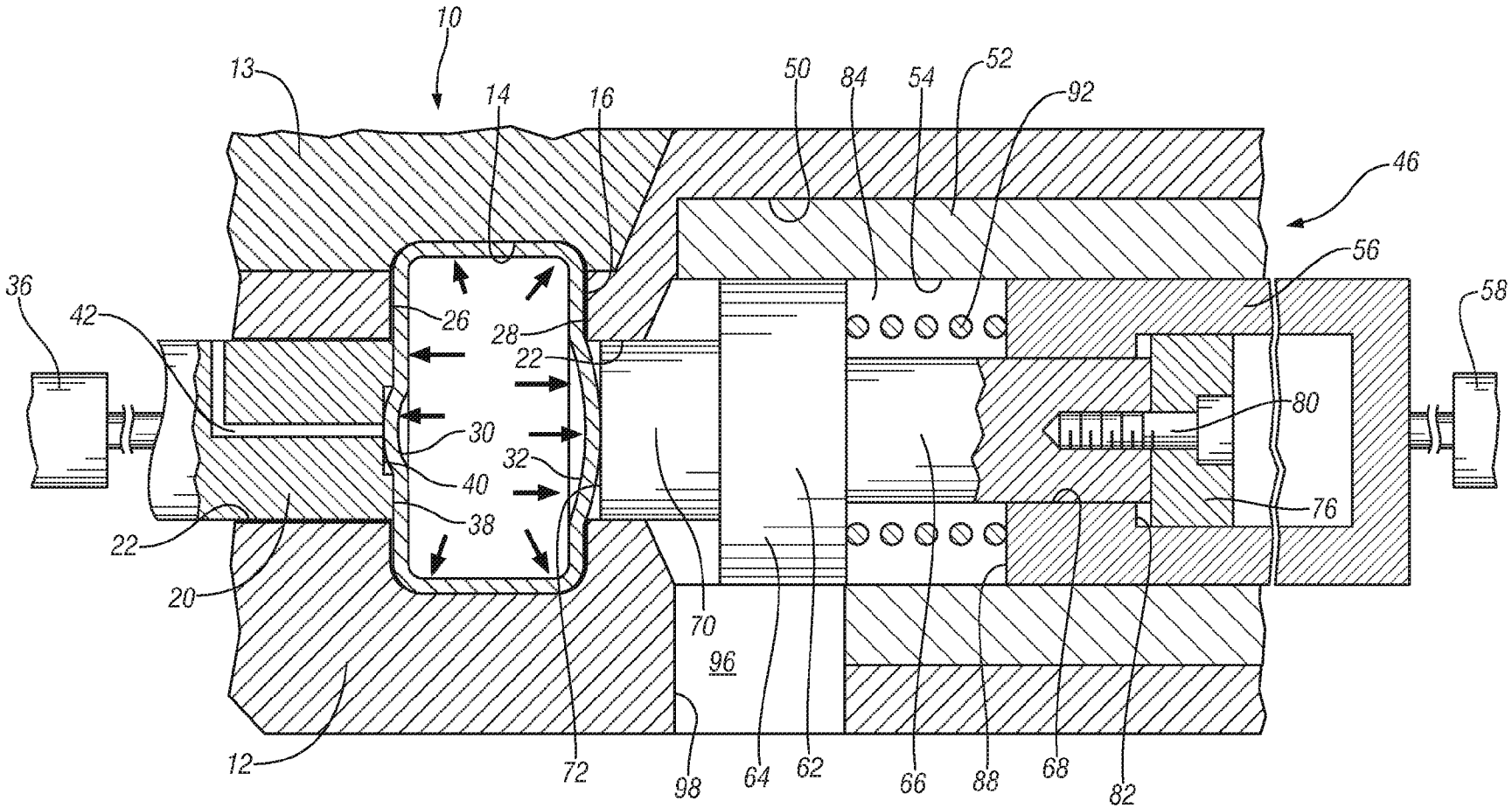
FIG. 2 is a view similar to FIG. 1 but showing the tube being expanded by pressurized fluid.

Referring to FIG. 2, fluid pressure is applied to the inside of the tube 16, and this fluid pressure, typically in the range of 5000 p.s.i. to 25,000 p.s.i. pounds per square inch, is shown to have bulged the left tube wall 30 outwardly into the counter bore 40 of the punch 20. Also, the fluid pressure has bulged the right tube wall 32 as the coil compression spring 92 yields somewhat and allows the support rod 62 be pushed to the right. However, the coil compression spring maintains sufficient force on the support rod 62 that the support face 72 will support the right tube wall 32 so that the fluid pressure cannot rupture a hole in the right tube wall 32 at the plunger bore 22.

Figure 3:
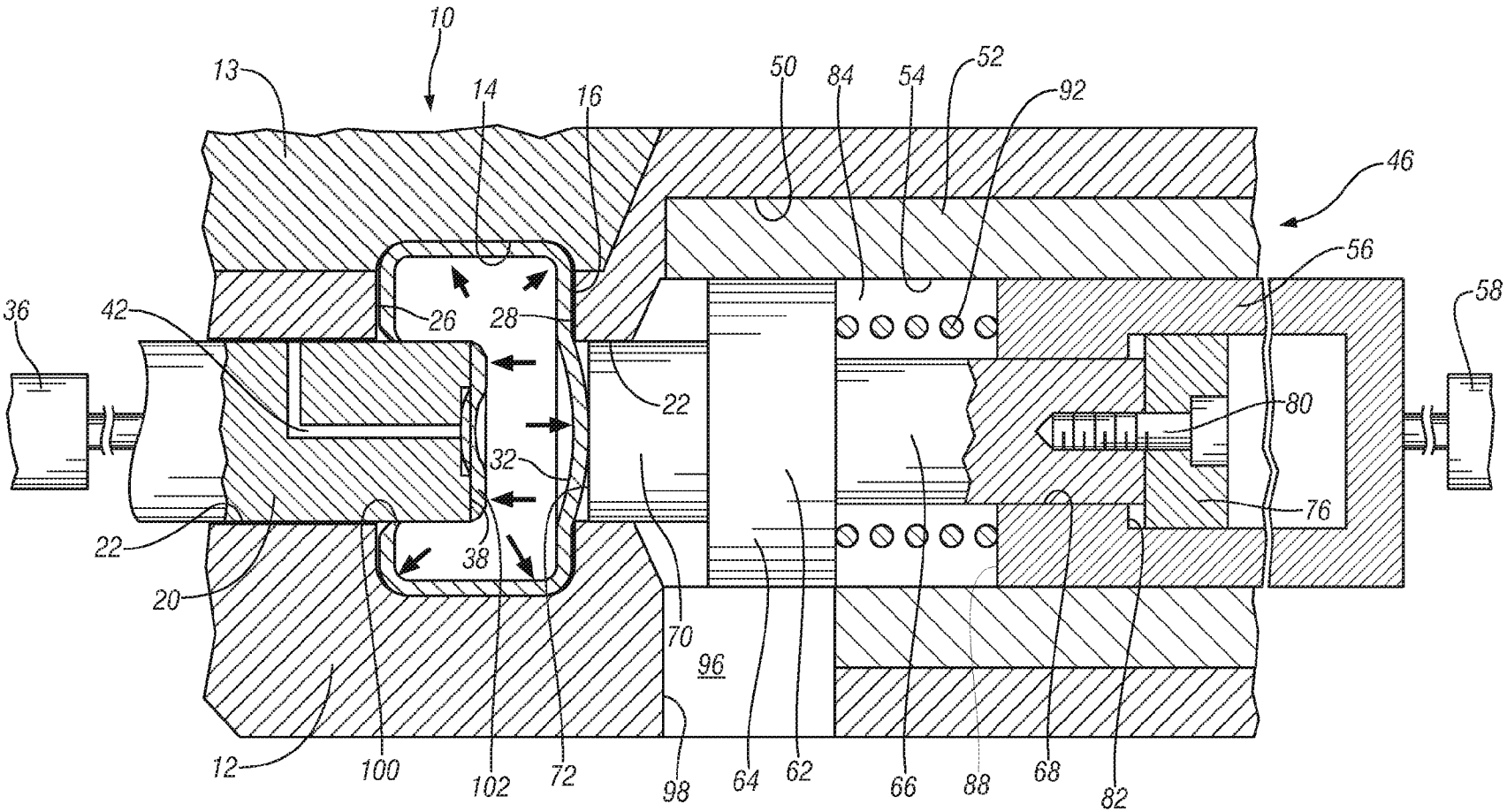
FIG. 3 is a view similar to FIG. 1 but showing a punch that has been advanced to punch a hole in one wall of the tube.

Referring to FIG. 3, the hydraulic cylinder 36 has been actuated to drive the punch 20 into the punch bore 22 so that punch face 38 has pierced through the left tube wall 30 and created a hole 100 and a slug 102. The vent 42 communicates to atmospheric pressure, thereby creating a differential pressure across the slug 102 so that the slug 102 is held in place and carried by the punch 20 as the punch 20 advances. In addition, FIG. 3 shows that the right tube wall 32 continues to be supported by the support face 72 of support rod 62 due to the spring force of the coil compression spring 92.

FIG. 4 shows that punch 20 has advanced across the inside of the tube 16 and driven the slug 102 to pierce a hole 104 through the right tube wall 32, thereby creating a slug 106. As the punch continues to advance, the support rod 62 is allowed to move further to the right as permitted by further yielding and compression of the compression coil spring 92 as the force of the compression coil spring 92 cannot resist the greater force that is imposed upon the punch 20 by the hydraulic cylinder 36. The slugs 102 and 106 remain captured between the punch face 38 of punch 20 and the support rod face 72 of the support rod 62 and are pushed into the punch bore 22.

Figure 5:
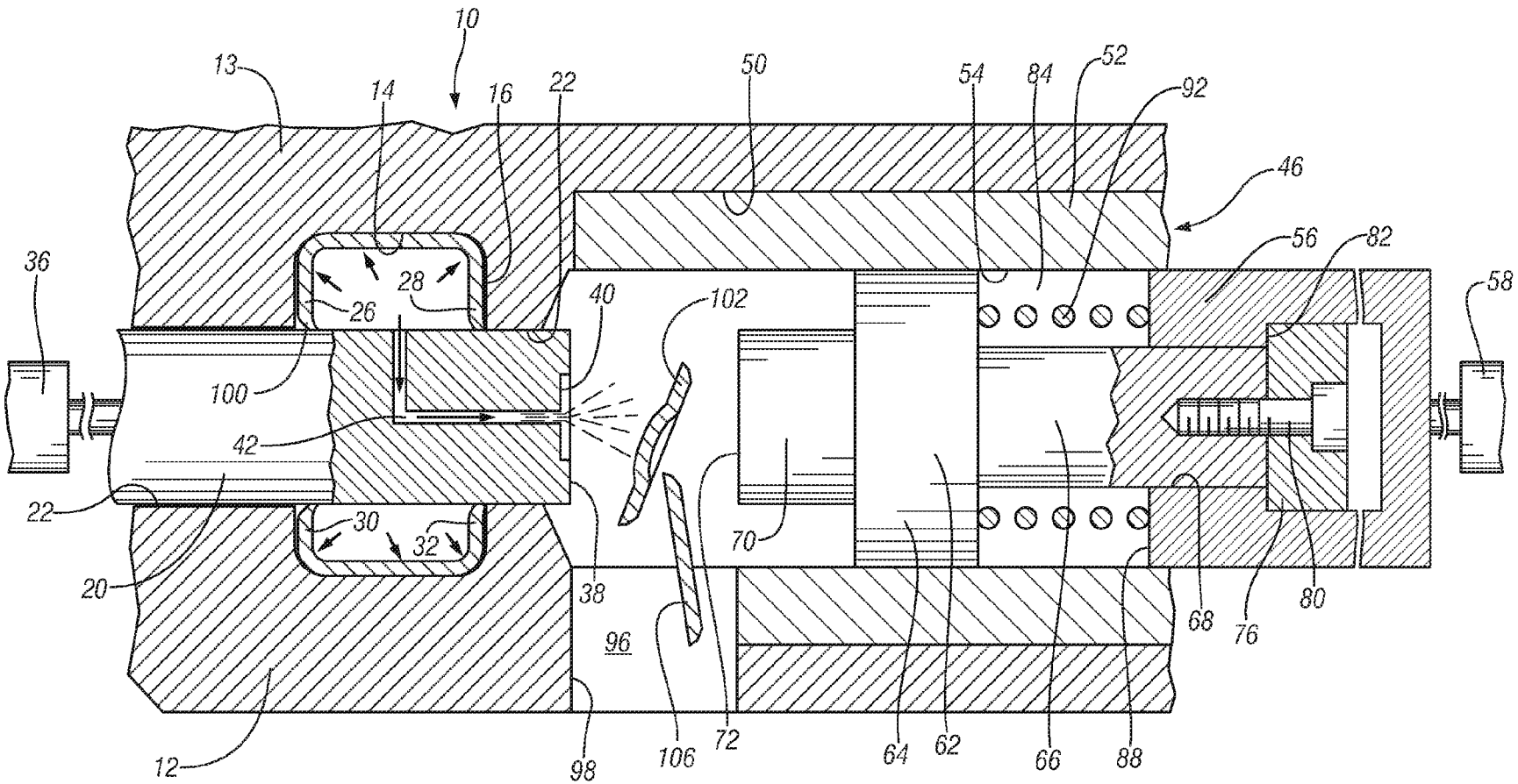
FIG. 5 is a view similar to FIG. 1 but showing slugs being discarded.

Referring to FIG. 5, it seen that the hydraulic cylinder 58 has been actuated to allow the coil compression spring 92 to extend and also have the shoulder 82 of the shaft 56 catch the stop washer 76 and withdraw the support face 72 of the support rod 62 away from the punch bore 22, and away from the slugs 102 and 106 so that the slugs are released and then fall through the discard chute 96 to be disposed of. In some cases the slug 102, may be adhered to the punch face 38. But, as seen in FIG. 5, the vent hole 42 has come into communication with the interior of the tube 16 so that the fluid pressure is communicated through the punch counter bore 40 and ejects the slug 102 from the punch face 38. It is preferred that the release of the fluid pressure within the tube 16 be coordinated with the piercing operation so that sufficient fluid pressure will remain in the tube 16 to effectively eject the slugs.

Thereafter, the hydraulic cylinders 36 and 58 will be actuated to return the punch 20 and the support rod 62 to their positions of FIG. 1 so that the dies can be opened and the tube 16 removed from the die cavity 14.

The spring rate of the coil compression spring 92 is selected to provide the desired level of support to the support rod 62, and yet to also provide the degree of yieldability and travel of the support rod 62 that is needed when the punch 20 begins to pierce through the right tube wall 32. As such, the spring rate will be determined and will vary depending upon factors such as the size of the hole to be pierced, the thickness of the tube wall.

The foregoing description of the invention is merely exemplary in nature and, thus, variations thereof are intended to be within the scope of the invention. Although the drawings show a coil compression spring 92 that is housed with in the chamber 84 it will be understood that other force yieldable devices may be employed. For example, a block of visco-elastic material, such as urethane, or a hydraulic or pneumatic pressure device such as a nitrogen spring may be employed to provide a yieldable support for the support rod 62.

What is claimed is:

1. Apparatus for piercing a hole through the opposed first and second tube walls of a hydroformed tube while the tube is within the die cavity formed by a pair of hydroforming dies, comprising:

a punch bore in one of the hydroforming dies, said punch bore extending into the die on opposed sides of the die cavity and adjacent to the first and second tube walls;

a single punch mounted in the punch bore adjacent the first wall of the tube;

a punch actuator for advancing the punch to make a first hole by punching a first slug from the first wall and then travel across the cavity and make a second hole by punching a second slug from the second wall of the tube and then push the slugs into the punch bore beyond the second wall;

and a support mechanism including:

a support rod slidably mounted in the punch bore adjacent the second wall of the tube and having a support face for supporting the second wall against rupture by the hydroforming pressure;

a yieldable compression spring for yieldably supporting the support rod and having a first end engaging the support rod on a side thereof opposite the support face and a second end;

a support actuator engaging the second end of the spring to normally maintain the compression of the compression spring so that the spring biases the support rod against the second wall of the tube with sufficient force to support the second wall of the tube against rupture by the hydroforming pressure and yet yield upon the punch actuator having made the second hole by punching a slug from the second wall of the tube into the punch bore beyond the second wall, said support actuator being further actuatable to withdraw force from the second end of the spring so that compression spring extends and force is relieved from the support rod, and said support actuator having a shoulder for engaging with the support rod upon still further actuation of the actuator so that the support rod is further withdrawn by the actuator independent of effort by the spring to withdraw the support rod away from the second wall of the tube and away from the punch and the slugs so that the slugs are released for disposal.

2. The apparatus of claim 1 in which a slug disposal chute communicates with the plunger bore to receive the first and second slugs for disposal thereof.

3. The apparatus of claim 1 further comprising said spring being a coil compression spring.

4. The apparatus of claim 1 further comprising said spring being an elastomeric spring.

5. The apparatus of claim 1 further comprising said spring being a fluid pressure spring device.

6. The apparatus of claim 1 further comprising said punch actuator being a hydraulic cylinder.

7. The apparatus of claim 1 further comprising the support rod actuator being a hydraulic cylinder.

8. Apparatus for piercing a hole through the opposed first and second tube walls of a hydroformed tube while the tube is within the die cavity formed by a pair of hydroforming dies, comprising:

a punch bore in one of the hydroforming dies, said punch bore extending into the die on opposed sides of the die cavity and adjacent to the first and second tube walls;

a single punch mounted in the punch bore adjacent the first wall of the tube;

a punch actuator including a hydraulic cylinder for advancing the punch to make a first hole by punching a first slug from the first wall and then travel across the cavity and make a second hole by punching a second slug from the second wall of the tube and then push the slugs into the punch bore beyond the second wall;

a slug disposal chute underlying the punch bore beyond the second tube wall;

and a support mechanism including:

a support rod slidably mounted in the punch bore adjacent the second wall of the tube and having a support face for supporting the second wall against rupture by the hydroforming pressure;

a yieldable compression spring for yieldably supporting the support rod and having a first end engaging the support rod on a side thereof opposite the support face and a second end;

a support actuator including a hydraulic cylinder engaging the second end of the spring to normally maintain the compression of the compression spring so that the spring biases the support rod against the second wall of the tube with sufficient force to support the second wall of the tube against rupture by the hydroforming pressure and yet yield upon the punch actuator having made the second hole by punching a slug from the second wall of the tube into the punch bore beyond the second wall, said support actuator being further actuatable to withdraw force from the second end of the spring so that compression spring extends and force is relieved from the support rod, and said support actuator having a shoulder for engaging with the support rod upon still further actuation of the actuator so that the support rod is further withdrawn by the actuator independent of effort by the spring to withdraw the support rod away from the second wall of the tube and away from the punch and the slugs so that the slugs are released for disposal.

9. The apparatus of claim 1 further comprising said spring being a coil compression spring.

10. The apparatus of claim 1 further comprising said spring being an elastomeric spring.

11. The apparatus of claim 1 further comprising said spring being a fluid pressure spring device.

* * * * *